US010988832B2

(12) United States Patent
Shirai et al.

(10) Patent No.: US 10,988,832 B2
(45) Date of Patent: Apr. 27, 2021

(54) TITANIUM-CONTAINING STRUCTURE AND TITANIUM PRODUCT

(71) Applicant: NIPPON STEEL & SUMITOMO METAL CORPORATION, Tokyo (JP)

(72) Inventors: Yoshihisa Shirai, Tokyo (JP); Hideki Fujii, Tokyo (JP); Tomoyuki Kitaura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 631 days.

(21) Appl. No.: 15/514,659

(22) PCT Filed: Oct. 7, 2015

(86) PCT No.: PCT/JP2015/078546
§ 371 (c)(1),
(2) Date: Mar. 27, 2017

(87) PCT Pub. No.: WO2016/056607
PCT Pub. Date: Apr. 14, 2016

(65) Prior Publication Data

US 2017/0233850 A1 Aug. 17, 2017

(30) Foreign Application Priority Data

Oct. 8, 2014 (JP) ..... JP2014-207495

(51) Int. Cl.
*B32B 15/00* (2006.01)
*C22C 14/00* (2006.01)
(Continued)

(52) U.S. Cl.
CPC ..... *C22C 14/00* (2013.01); *B21B 3/00* (2013.01); *B21C 23/002* (2013.01); *B21C 23/01* (2013.01); *C22F 1/183* (2013.01)

(58) Field of Classification Search
None
See application file for complete search history.

(56) References Cited

U.S. PATENT DOCUMENTS 4,829,152 A * 5/1989 Rostoker ..... A61F 2/30907 219/78.02
5,224,534 A 7/1993 Shimizu et al.
(Continued)

FOREIGN PATENT DOCUMENTS

CN 1192494 9/1998
CN 203601620 5/2014
(Continued)

OTHER PUBLICATIONS

Mae e tat., Machine translation JP S62-47433, Mar. 2, 1987 (Year: 1987).*
(Continued)

*Primary Examiner* — Humera N. Sheikh
*Assistant Examiner* — Mary I Omori
(74) *Attorney, Agent, or Firm* — Clark & Brody LP

(57) ABSTRACT

A titanium-containing structure made of a titanium material includes: a package made of a commercially pure titanium material; and a filler packed into the package, wherein an internal pressure of the package is 10 Pa or less, the pressure being an absolute pressure, and wherein the filler includes at least one selected from titanium sponge, titanium briquette, and titanium scrap, and the filler has the same type of a chemical composition of the commercially pure titanium material. This titanium-containing structure enables production of a titanium product by performing hot working and eliminating the conventional melting step and forging step.

5 Claims, 1 Drawing Sheet

(51) Int. Cl.

| | |
|---|---|
| ***B21B 3/00*** | (2006.01) |
| ***C22F 1/18*** | (2006.01) |
| ***B21C 23/00*** | (2006.01) |
| ***B21C 23/01*** | (2006.01) |

(56) References Cited

U.S. PATENT DOCUMENTS

| | | | | |
|---|---|---|---|---|
| 5,564,064 | A * | 10/1996 | Martin | B22F 3/1125 29/527.1 |
| 5,579,988 | A | 12/1996 | Schutz et al. | |
| 5,903,813 | A | 5/1999 | Moxson et al. | |
| 5,972,521 | A * | 10/1999 | Huskamp | B22F 7/006 29/527.1 |
| 2004/0035503 | A1 | 2/2004 | Fujii et al. | |
| 2005/0112397 | A1 * | 5/2005 | Rolfe | A61B 17/866 428/593 |
| 2011/0072661 | A1 | 3/2011 | Voice | |

FOREIGN PATENT DOCUMENTS

| | | | | |
|---|---|---|---|---|
| EP | 3 330 012 | | 6/2018 | |
| EP | 3 330 077 | | 6/2018 | |
| JP | S6247433 | B2 * | 10/1987 | B01J 8/20 |
| JP | 63-080904 | | 4/1988 | |
| JP | 63-207401 | | 8/1988 | |
| JP | 04-131330 | | 5/1992 | |
| JP | 05-70805 | | 3/1993 | |
| JP | 08-067921 | | 3/1996 | |
| JP | 09-136102 | | 5/1997 | |
| JP | 11-057810 | | 3/1999 | |
| JP | 2001-131609 | | 5/2001 | |
| JP | 2008-095168 | | 4/2008 | |
| JP | 2011-042828 | | 3/2011 | |
| JP | 2012-041583 | | 3/2012 | |
| JP | 2012087373 | A * | 5/2012 | |
| JP | 2014-019945 | | 2/2014 | |
| JP | 2014-065968 | | 4/2014 | |
| JP | 2015-045040 | | 3/2015 | |
| JP | 2015045040 | A * | 3/2015 | |
| RU | 2335553 | | 10/2008 | |

OTHER PUBLICATIONS

Ikeda et al., Machine translation of JP 2012-041583, Mar. 1, 2012 (Year: 2012).*

Sugawara et al., Machine translation of JP 2014-065968, Apr. 17, 2014 (Year: 2014).*

Titanium Grade Overview, Dec. 11, 2010, superalloys.com (Year: 2010).*

Akira Igarashi, machine translation of JP 2012-087373 Abstract and Description, May 10, 2012 (Year: 2012).*

Oldani et al., Titanium as a Biomaterial for Implants, Jan. 27, 2012 (Year: 2012).*

Kaehashi et al., machine translation of JP 2015-045040, Mar. 12, 2015 (Year: 2015).*

Shi Mei-qin et al., "Microstructure and texture . . . and subsequent annealing", Science Direct, Trans. Nonferrous Met. Soc. China 22 (2012), p. 2616-2627.

* cited by examiner

TITANIUM-CONTAINING STRUCTURE AND TITANIUM PRODUCT

TECHNICAL FIELD

The present invention relates to a titanium-containing structure and titanium products such as a titanium plate and a titanium bar.

BACKGROUND ART

Titanium products are metal materials having excellent corrosion resistance and thus are used, for example, in heat exchangers using sea water and a variety of chemical plants. Also, since they have lower densities than carbon steels and thus have high specific strengths (strength per unit weight), they are frequently used in aircraft airframes. Furthermore, use of a titanium product in land transport equipment such as motor vehicles results in reduced weight of the equipment and therefore is expected to contribute to improved fuel economy.

However, compared with steel products, titanium products are produced through complex and numerous steps. Typical steps include the following.

Smelting step: a step of chlorinating titanium oxide, the raw material, into titanium tetrachloride and then reducing it with magnesium or sodium to produce titanium metal in massive sponge form (hereinafter referred to as titanium sponge).

Melting step: a step of pressing the titanium sponge to form an electrode and melting it in a vacuum arc melting furnace to produce an ingot.

Forging step: a step of hot forging the ingot to produce, for example, a slab (material for hot rolling) or a billet (material for hot extrusion or hot rolling, for example).

Hot working step: a step of heating the slab or billet and hot rolling or hot extruding it to produce a plate or round bar, for example.

Cold working step: a step of additionally cold rolling the plate or round bar to produce a sheet, round bar, or wire, for example.

As described above, titanium products are produced through many steps, and therefore they are very expensive. For this reason, they are seldom utilized in land transport equipment such as motor vehicles. Encouraging the use of titanium products requires an improvement in productivity of the production process. As a technique for addressing the problem, attempts to eliminate some steps in production of titanium products have been made.

Patent Document 1 proposes a method for producing a titanium sheet, the method including shaping a composition containing a titanium powder, a binding agent, a plasticizer, and a solvent into sheet form, and subjecting it to drying, sintering, compaction, and re-sintering. This method can eliminate the ordinary melting, forging, and hot and cold rolling steps.

Patent Document 2 proposes a method for producing a titanium alloy round bar, the method including adding a copper powder, chromium powder, or iron powder to a titanium alloy powder, enclosing it in a capsule made of carbon steel, and subjecting it to heating and hot extrusion. This method can eliminate the ordinary melting and forging steps and therefore reduce the production cost.

Patent Document 3 proposes a method for producing a round bar, the method including charging a titanium sponge powder into a copper capsule, heating it to not greater than 700° C., and subjecting it to warm extrusion. This method can eliminate the ordinary melting and forging steps and therefore reduce the production cost.

Furthermore, the conventionally known pack rolling is a process including covering a less workable core material such as a titanium alloy material with a cover member made of, for example, carbon steel, which is inexpensive and highly workable, and subjecting it to hot rolling. For example, after a release agent is applied to the surfaces of the core material, at least two upper and lower surfaces thereof are covered with cover members or four peripheral surfaces, in addition to the upper and lower surfaces, are covered with cover members, welding is applied to the seams to produce a sealed covered box, and the inside thereof is evacuated and sealed to be subjected to hot rolling.

Patent Document 4 discloses a method for assembling a sealed covered box; Patent Document 5 discloses a method for producing a sealed covered box, the method including sealing (packing) a cover member at a vacuum pressure of not less than $10^{-3}$ torr (approximately 0.133 Pa); and Patent Document 6 discloses a method for producing a sealed covered box, the method including covering the material with a carbon steel (cover member) and sealing (packing) it by high energy density welding under a vacuum of not greater than $10^{-2}$ torr (about 1.33 Pa).

In each pack rolling described above, the core material, which is the material to be rolled, is covered with a cover member to be subjected to hot rolling, and therefore, the surface of the core material is not brought into direct contact with a cold medium (such as air or a roll) so that the temperature decrease in the core material can be minimized, which makes it possible to produce a sheet even from a less workable core material.

The cover member used is made of a material different from that of the core material, e.g., carbon steel, which has good workability and is inexpensive. The surface of the core material includes a release agent applied thereto so that the cover member can be separated easily from the core material because the cover member is unnecessary after hot rolling.

LIST OF PRIOR ART DOCUMENTS

Patent Document

Patent Document 1: JP2011-042828A
Patent Document 2: JP2014-019945A
Patent Document 3: JP2001-131609A
Patent Document 4: JP63-207401A
Patent Document 5: JP09-136102A
Patent Document 6: JP11-057810A

SUMMARY OF INVENTION

Technical Problem

In the method disclosed in Cited Document 1, a titanium powder (having an average particle size of 4 to 200 μm), which is expensive, is used as the material and many steps including sintering and compaction are involved, and therefore the resultant titanium sheets are very expensive, and consequently use of titanium products has not been encouraged.

In the method disclosed in Cited Document 2, a titanium powder alloy, which is expensive, is used as the material and therefore the resultant titanium alloy round bars are expensive, and consequently use of titanium products has not been encouraged. The method poses problems in that, for example, the resultant round bars include titanium oxide in the surface layer and inner portion because the titanium sponge powder becomes oxidized when heated and therefore they have discolored appearance and low tensile properties compared with round bars produced through the typical process.

The method disclosed in Cited Document 3 poses problems in that, for example, the resultant round bars include titanium oxide in the surface layer and inner portion because the titanium sponge powder becomes oxidized when heated and therefore they have discolored appearance and low tensile properties compared with round bars produced through the typical process.

In the methods disclosed in Cited Documents 4 to 6, the cover members have to be removed and disposed of after rolling as in pack rolling and therefore the production cost is higher than the cost of the typical process, and as a result, the resultant titanium products are similarly expensive.

Consequently, titanium products have not yet been utilized in land transport equipment such as motor vehicles.

In view of the above circumstances, an object of the present invention is to produce titanium products such as titanium plates and round bars at low cost.

Solution to Problem

The present inventors made intense research to solve the problems described above and have conceived a titanium-containing structure that enables elimination of the melting step and the forging step.

They have directed their attention to titanium sponge, which is massive and does not have a fixed shape, as a material to be used rather than powders such as a titanium powder and a titanium sponge powder, which are expensive. The massive titanium sponge can be obtained at relatively low cost because it is produced through the conventional process. Furthermore, producing titanium products directly from titanium sponge poses no problem associated with the composition because major impurities are removed in the smelting step. Materials in briquet form obtained by compression molding titanium sponge (hereinafter referred to as "titanium briquet") and titanium materials such as scrap materials, which cannot form finished products per se, (hereinafter referred to as "titanium scrap"), can be obtained at relatively low cost. However, these materials cannot be processed directly because they are not in a fixed shape.

In view of this, the present inventors have devised a titanium-containing structure that can be formed by charging a filler such as titanium sponge into a container (hereinafter referred to as "package") formed from a commercially pure titanium material and sealing the package. With a titanium material of this configuration, it is possible to inhibit the occurrence of surface cracks or surface defects such as scabs during hot working. In particular, by using a filler having the same type of a chemical composition the commercially pure titanium material, it is possible to retain the package and allow it to become part of the titanium product (end product) after working unlike in the conventional pack rolling, in which the cover member has to be removed and disposed of after rolling. Furthermore, it has also been found that reducing the internal pressure of the package as much as possible is important to prevent the filler such as titanium sponge from being oxidized when it is heated prior to hot working and also to facilitate reduction of voids between the fillers and between the package and the filler during hot working.

The summaries of the present invention are a titanium-containing structure and a titanium product set forth below.

(1) A titanium-containing structure having:

a package made of a commercially pure titanium material; and a filler packed into the package, wherein an internal pressure of the package is 10 Pa or less, the pressure being an absolute pressure and wherein the filler comprises at least one selected from titanium sponge, titanium briquet, and titanium scrap, and the filler has the same type of a chemical composition of the commercially pure titanium material.

(2) The titanium-containing structure according to the above (1), wherein the package and the filler has a chemical composition stipulated in JIS Class 1 to JIS Class 4.

(3) A titanium product having a chemical composition stipulated in JIS Class 1 to JIS Class 4, wherein a void fraction in an inner portion of the titanium product is more than 0% and 30% or less.

Advantageous Effects of Invention

Use of the titanium-containing structure of the present invention enables production of titanium products by performing working while eliminating the conventional melting step and forging step. As a result, the energy (such as electricity or gas) necessary for the production is reduced. Furthermore, the production yield is significantly improved because the production is accomplished without removal of large amounts of titanium material by cutting or severing, i.e., for example, removal by cutting of defective portions that are present mainly in the surface layer and bottom surface of an ingot or removal of surface cracks and poorly shaped front and rear end portions (crops) after forging. As a result, a significant reduction in production cost is achieved.

Furthermore, when processed under suitable conditions, the titanium-containing structure produced by the present invention can be made into a titanium product with few voids which has tensile properties comparable to those of conventional products or a lightweight titanium product having many internal voids. Conventional products, which are produced through the melting step, have no voids.

DESCRIPTION OF EMBODIMENTS

A titanium-containing structure and titanium products of the present invention will be described below in order.

Figure 1:
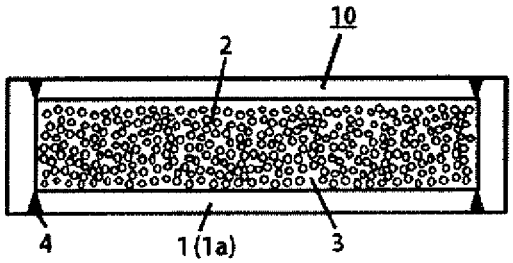
FIG. 1 schematically illustrates a configuration of a titanium-containing structure of the present invention.
Figure 2:
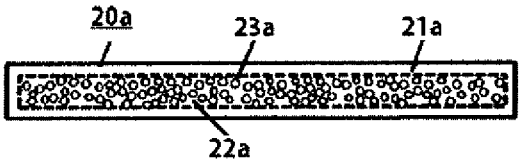
FIG. 2 schematically illustrates a configuration of a titanium product (plate) of the present invention.
Figure 3:
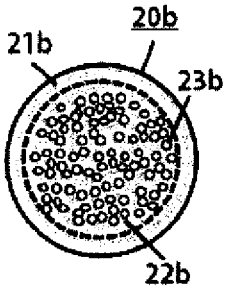
FIG. 3 schematically illustrates a configuration of a titanium product (bar) of the present invention.

As illustrated in FIG. 1, a titanium-containing structure 10 of the present invention is a material for working made of a titanium material including: a package 1 made of a commercially pure titanium material 1*a*; and a filler 2 packed into the package 1. The internal pressure of the package 1 is not greater than 10 Pa, the filler 2 includes at least one selected from titanium sponge, titanium briquet, and titanium scrap, and the filler 2 has the same type of a chemical composition of the commercially pure titanium material.

Firstly, the filler 2 will be described.

[Size]

When titanium sponge is used as the filler 2, titanium sponge produced through a smelting process such as in the conventional Kroll process may be used. The titanium sponge produced through the smelting process is a large mass, typically weighing several tons, and therefore it is appropriate to crush it to particles with an average particle size of not greater than 30 mm and use the particles as in the conventional process.

The particle size of the filler 2 needs to be smaller than the size of the interior space of the package 1. The filler 2 may be packed as it is into the package 1, but to increase efficiency or to increase the amount that can be loaded, it is possible to use a molded body (titanium briquet) prepared by previously compression molding titanium sponge. In particular, when a titanium product having a low void fraction is to be produced, it is preferred to employ titanium briquet as the filler 2 and load it within the package 1.

Preferably, the filler 2 is sized to have an average particle size of not less than 1 mm and not greater than 30 mm. If it is less than 1 mm, it will take time to carry out crushing and also large amounts of fine dust particles will be generated and scatter, and as a result, the production efficiency will decrease. If the average particle size is greater than 30 mm, the work efficiency will decrease because of, for example, difficulty in handling for transport and difficulty in placement in the package 1.

[Components]

The filler 2 needs to have the same type of a chemical composition of the package 1, i.e., the commercially pure titanium material. For example, the chemical composition corresponds to JIS Class 1, JIS Class 2, JIS Class 3, or JIS Class 4. Herein, having a chemical composition of the same type means, specifically, belonging to the same class of JIS standard. For example, when the chemical composition of the package 1 belongs to JIS Class 1, the filler 2 needs to have a chemical composition belonging to JIS Class 1. Thus, the chemical composition of the filler 2 is selected to be of the same class as the chemical composition of the commercially pure titanium material, and thereby, in the titanium product after working, the chemical compositions in the surface layer and the inner portion are comparable to each other, so that the titanium product as it is can be dealt with as commercially pure titanium.

JIS Class 1 includes 0.15% by mass or less oxygen, 0.20% by mass or less iron, 0.03% by mass or less nitrogen, 0.08% by mass or less carbon, and 0.013% by mass or less hydrogen; JIS Class 2 includes 0.20% by mass or less oxygen, 0.25% by mass or less iron, 0.03% by mass or less nitrogen, 0.08% by mass or less carbon, and 0.013% by mass or less hydrogen; JIS Class 3 includes 0.30% by mass or less oxygen, 0.30% by mass or less iron, 0.05% by mass or less nitrogen, 0.08% by mass or less carbon, and 0.013% by mass or less hydrogen; and JIS Class 4 includes 0.40% by mass or less oxygen, 0.50% by mass or less iron, 0.05% by mass or less nitrogen, 0.08% by mass or less carbon, and 0.013% by mass or less hydrogen.

The following is a description of titanium scrap that may be used as the filler 2.

Examples of titanium scrap include: scrap materials that are generated during the process of producing a commercially pure titanium product and which cannot form an end product per se; titanium chips that are generated during cutting or grinding a commercially pure titanium material into the shape of an end product; and commercially pure titanium products that have become unnecessary after being used as an end product.

If the size of the titanium scrap is excessively large and the work efficiency is decreased because of, for example, difficulty in transport or difficulty in placement in the package 1, it is preferred to sever the scrap appropriately.

The titanium scrap may be packed as it is into the package 1, or alternatively, the efficiency of loading and the amount of loading can be increased in the following manner. In the case of titanium chips for example, which have a low bulk density, they may be previously mixed with titanium sponge and subjected to compression molding, or titanium scrap alone may be subjected to compression molding to make a molded body, so as to be packed into the package 1.

The following is a description of the commercially pure titanium material that forms the package 1.

An example of the commercially pure titanium material is a wrought titanium material. The wrought titanium materials include titanium plates and titanium pipes that are formed by hot or cold plastic working such as rolling, extrusion, drawing, or forging. Industrial wrought commercially pure titanium materials, which have been subjected to plastic working, advantageously have a smooth surface and fine structure (fine grains).

[Thickness]

When the package 1 is a rectangular parallelepiped, the thickness of the commercially pure titanium material is preferably not less than 0.5 mm and not greater than 50 mm although depending on the size of the package 1 to be produced. As the size of the package 1 increases, increased strength and stiffness are necessary, and therefore a commercially pure titanium material having a greater thickness is to be used. If the thickness is less than 0.5 mm, the package 1 may deform during heating prior to hot working or it may fracture at an initial stage of the hot working, and therefore such a thickness is not preferred. If the thickness is greater than 50 mm, the commercially pure titanium material accounts for a large proportion in the thickness of the titanium-containing structure 10 and the amount of the packed filler 2 is small, and therefore the amount of the filler 2 to be worked is small and the production efficiency is low. Thus, such a thickness is not preferred.

Furthermore, the thickness of the commercially pure titanium material is preferably not less than 3% of the thickness of the titanium-containing structure 10 and not greater than 25% thereof. If the thickness of the commercially pure titanium material is smaller than 3% of the thickness of the titanium-containing structure 10, it becomes difficult for it to hold the filler 2, and as a result, the titanium-containing structure 10 can undergo large deformation during heating prior to hot working or the weld zone of the package 1 can fracture. If the thickness of the commercially pure titanium material is greater than 25% of the thickness of the titanium-containing structure 10, although there are no particular problems for the production, the commercially pure titanium material accounts for a large proportion in the thickness of the titanium-containing structure 10 and the amount of the packed filler 2 is small, and therefore the amount of the filler 2 to be worked is small and the production efficiency is low. Thus, such a thickness is not preferred.

In the case where the package 1 is a pipe, similarly to the above, the thickness of the commercially pure titanium material is preferably not less than 0.5 mm and not greater than 50 mm although depending on the size of the package 1 to be produced. Furthermore, similarly to the case of the rectangular parallelepiped, the thickness of the commercially pure titanium material is preferably not less than 3% of the diameter of the titanium-containing structure 10 and not greater than 25% thereof.

[Components]

As described above, the package 1 needs to have the same type of a chemical composition of the filler 2.

[Grain Size]

The commercially pure titanium material can have its grains adjusted through suitable plastic working and heat treatment. The average grain size of the commercially pure titanium material that forms the package 1 is to be not greater than 500 μm in terms of the equivalent circular diameter. This inhibits surface flaws that may occur due to differences in the crystal orientation of coarse grains when the titanium-containing structure 10 is subjected to hot working. The lower limit is not particularly specified, but when an extremely small grain size in a commercially pure titanium is to be obtained, a high reduction rate in the plastic working would be necessary, and as a result, the thickness of the commercially pure titanium material that can be used as the package 1 would be limited. Thus, the grain size is preferably not less than 10 μm and more preferably greater than 15 μm. The grains of interest herein are grains in the α phase, which constitutes most part of a commercially pure titanium.

The average grain size is calculated in the following manner. Specifically, the structure in the cross section of the commercially pure titanium material is observed with an optical microscope and its photographs are taken, and from the photographs of the structure, the average grain size in the surface layer of the commercially pure titanium material is determined by the intercept method in accordance with HS G 0551 (2005).

The following is a description of the titanium-containing structure 10.

[Shape]

The shape of the titanium-containing structure 10 is not limited and it depends on the shape of the titanium product to be produced. When a titanium sheet or plate is to be produced, the titanium-containing structure 10 is to be of a rectangular parallelepiped shape (slab). The thickness, width, and length of the titanium-containing structure 10 depend on the thickness, width, and length of the product as well as the production volume (weight), for example.

When a titanium round bar, wire, or extruded section is to be produced, the titanium-containing structure 10 is to be in the shape of a cylinder or a polygonal prism such as an octagonal prism (billet). The size (diameter and length) depends on the size, thickness, width, and length of the product as well as the production volume (weight), for example.

[Inside]

Within the titanium-containing structure 10 is packed the filler 2 such as titanium sponge. The filler 2 is a mass of particles and therefore includes voids 3 between the particles. If air is present in the voids 3, the filler 2 will become oxidized or nitrided when heated prior to hot working and the titanium product produced through the subsequent working will become embrittled and consequently fail to exhibit necessary material properties. Oxidation or nitridation of the titanium sponge can be inhibited by charging an inert gas such as Ar gas. However, the Ar gas will thermally expand during heating and extend the package 1 outward, and this will cause the titanium-containing structure 10 to deform, which will make it impossible to apply hot working thereto.

For the reasons described above, the internal pressure in the voids 3 between the particles of the filler 2 needs to be as low as possible. Specifically, the internal pressure is to be not greater than 10 Pa. Preferably, the internal pressure is not greater than 1 Pa. If the internal pressure of the package 1 is greater than 10 Pa, the filler 2 becomes oxidized or nitrided by the remaining air. There is no particular limit to the lower limit, but an extreme reduction of the internal pressure involves an increase in the production cost, e.g., for improving the sealing properties of the equipment or for reinforcing the evacuation equipment, and therefore a lower limit of $1\times10^{-3}$ Pa is preferred.

The following is a description of how the internal pressure of the package 1 is reduced and vacuum is maintained therein.

The package 1 is sealed after the filler 2 has been packed therein and the internal pressure therein has been reduced to a predetermined pressure or lower. Alternatively, pieces of the commercially pure titanium material may be partially joined together and then the pressure reduction and sealing may be performed. The sealing prevents intrusion of air and thus prevents oxidation of the filler 2 inside during heating prior to hot working.

The sealing process is not particularly limited but sealing by welding of the pieces of the commercially pure titanium material is preferred. In this case, as for the welding location, all the seams between the pieces of commercially pure titanium material are welded, i.e., all-around welding is performed. The process for welding the commercially pure titanium material is not particularly limited, and arc welding such as TIG welding and MIG welding, electron beam (EB) welding, or laser welding, for example, may be employed.

As for the welding atmosphere, the welding is performed in a vacuum atmosphere or in an inert gas atmosphere to prevent oxidation and nitridation of the filler 2 and the inner surface of the package 1. In the case where welding of the seams of the commercially pure titanium material is performed last, it is preferred that the package 1 is placed within a vacuum vessel (chamber) to be welded so that the interior of the package 1 can be held at vacuum.

Alternatively, a tube may be previously provided at a portion of the package 1 so that the internal pressure can be reduced to a predetermined pressure through the tube and the tube can be sealed for example by crimping after the entire perimeter has been welded in an inert gas atmosphere, and thereby vacuum can be formed within the package 1. In this case, the tube is provided at a location that does not cause interference with hot working, which is the downstream process, and the location may be, for example, the rear end face.

The following is a description of the titanium product.

The titanium product of the present invention has a chemical composition stipulated in JIS Class 1 to JIS Class 4 and a void fraction in an inner portion of the titanium product is more than 0% and 30% or less. Specifically, it is commercially pure titanium that can be obtained by heating the titanium-containing structure 10 and then subjecting it to hot working and optionally further to cold working.

The titanium product is made up of two structures, namely, an outer layer resulting from the package 1 in the titanium-containing structure 10 before working and an inner layer resulting from the filler 2 therein. Hereinafter, the inner portion of the titanium product refers to the inner layer. The chemical compositions of the package 1 and the filler 2 are of the same class, and therefore, in the titanium product, the chemical composition of the outer layer and the chemical composition of the inner layer are of the same class. Specifically, the chemical compositions are stipulated in JIS Class 1 to JIS Class 4.

[Void Fraction]

The voids 3 that are present within the titanium-containing structure 10 decrease through hot working or plus cold working applied to the titanium-containing structure 10, but they are not removed completely (the void fraction does not reach 0%) with some of them remaining. That is, the void fraction is greater than 0%. When the voids 3 are present in large amounts, the titanium product has a lower bulk density and thus is lightweight. However, if the voids 3 are present in excessively large amounts, the titanium product may have excessively reduced strength and ductility and thus may not be able to exhibit desired properties in the case of some end products. Accordingly, the upper limit of the void fraction is specified to be not greater than 30%, whereby the strength and ductility are ensured in end products in which the titanium product is required to exhibit such properties. That is, in order to produce a titanium product capable of exhibiting sufficient strength and ductility to be useable as an end product and which is also lightweight, the titanium product preferably includes the voids 3 in an amount of greater than 0% and not greater than 30% by volume.

The proportion of voids remaining in the inner portion of the titanium product (void fraction) is calculated in the following manner. The titanium product is cut so that a cross section of the inner portion of the titanium product can be observed, and the surface to be observed of the cross section is polished and mirror finished to an average surface roughness Ra of 0.2 μm or less to prepare a sample to be observed. For the polishing, diamond or alumina suspension, for example, is used.

In the sample to be observed, to which a mirror finish has been applied, photographs of 20 different locations at the center are taken with an optical microscope. Herein, the center refers to the center of the plate thickness in the case where the titanium product is a plate and refers to the center of the circular cross section in the case where the titanium product is a round bar. The area fractions of voids observed in the optical micrographs are measured and the result obtained by averaging the void fractions of the 20 photographs is designated as the void fraction. When taking photographs with an optical microscope, an appropriate magnification is selected in accordance with the void size and void fraction of the titanium product. For example, when the void fraction is not greater than 1%, the voids are small, and therefore the observation is carried out at a high magnification, e.g., 500-fold, to take photographs. When the void fraction is not less than 10%, large voids are present in greater amounts, and therefore it is preferred that the observation is carried out at a low magnification, e.g., 20-hold, to take photographs.

When the void fraction is not greater than 1%, in which case the voids are small, the use of a differential interference contrast microscope, which is capable of polarized light observation, is preferred because it allows for clearer observation than a typical optical microscope.

The voids formed within the titanium product result from two causes. One cause is voids formed between particles of titanium sponge or between pieces of titanium scrap, i.e., between particles of the filler, and voids formed between the filler and the package. The voids formed within the titanium-containing structure become smaller through hot working and subsequent cold working, and some of them or most of them collapse and disappear. The void fraction of the titanium product can be reduced by increasing the reduction ratio for the hot working or cold working. Also, the void fraction of the titanium product can be reduced by preparing titanium briquet by previously compression molding titanium sponge or titanium scrap. However, voids as small as several hundred micrometers in terms of the equivalent circular diameter cannot collapse easily even if the reduction ratio is increased and therefore remain in the titanium product. Causing complete collapse of all voids, i.e., achieving a void fraction of zero requires a very large reduction ratio, which amounts to a very large titanium-containing structure required, and therefore it is not practical in industrially producing titanium products.

The other cause of voids is chlorides contained in the titanium sponge. Titanium sponge produced by the Kroll process, which is a typical process for producing titanium sponge, contains chlorides such as magnesium chloride as incidental impurities. The chlorides are present in trace amounts in the inner portion of the titanium-containing structure including titanium sponge. When heating and hot working are applied to such titanium-containing structure, trace amounts of chlorides remain in the inner portion of the resultant titanium product because of the sealed structure. When the sample to be observed described above is being prepared to investigate the void fraction of the resultant titanium product, the chlorides are eliminated or dissolved in water and disappear with the traces thereof left. When such a sample is observed, the traces of the chlorides can be observed as the voids.

[Hot Working Process]

The titanium product (end product) is formed by subjecting the titanium-containing structure 10 to hot working. The process of hot working varies depending on the shape of the titanium product. When a titanium plate is to be produced, a titanium-containing structure 10 in the shape of a rectangular parallelepiped (slab) is heated and hot rolled to form the titanium plate. As with the conventional process, cold rolling may be performed as needed to make the product thinner after the oxidation layer has been removed by pickling for example.

When a titanium round bar or wire rod is to be produced, a titanium-containing structure 10 in the shape of a cylinder or a polygonal prism is heated and subjected to hot forging, hot rolling, or hot extrusion to form the titanium round bar or wire rod. In addition, as with the conventional process, cold rolling for example may be performed as needed to make the product thinner after the oxidation layer has been removed by pickling for example. When a titanium extruded section is to be produced, a titanium-containing structure 10 in the shape of a cylinder or a polygonal prism is heated and subjected to hot extrusion to form titanium sections having various cross-sectional shapes.

[Heating Temperature]

The temperature to which the titanium-containing structure 10 is heated prior to hot working varies depending on its size and the reduction ratio for the hot working, but it is in the range of not less than 600° C. and not greater than 1200° C. At temperatures less than 600° C., the titanium-containing structure 10 exhibits high high-temperature strength, and therefore a sufficient reduction ratio cannot be imparted to it. If the heating temperature is higher than 1200° C., the resulting titanium product will have coarse structure and therefore will not exhibit sufficient material properties, and the outer surface of the titanium-containing structure 10 will become oxidized to form a thick scale, which results in thinning of the titanium-containing structure 10 and in some cases formation of holes therein. Thus, such heating temperatures are not preferred.

[Reduction Ratio]

The degree of working for hot working and cold working, i.e., the reduction ratio (the rate obtained by dividing the difference between the pre-working cross-sectional area and the post-working cross-sectional area of the titanium product by the pre-working cross-sectional area) is to be adjusted in accordance with necessary properties of the titanium product. The proportion of voids in the inner portion of the titanium product (the portion resulting from the filler 2) can be adjusted by the reduction ratio for the titanium-containing structure 10. When a high degree of reduction (reduction that significantly reduces the cross-sectional area of the titanium-containing structure 10) is applied, most voids will disappear, and therefore tensile properties comparable to those of titanium products produced through the typical production process can be obtained. On the other hand, a low degree of reduction leaves many voids in the inner portion of the titanium product and therefore corresponding weight reduction of the titanium product is achieved.

When the titanium product needs to have strength and ductility, the reduction ratio may be increased (for example, to 90% or more) to cause sufficient collapse in the filler 2 inside to thereby reduce the void fraction in the inner portion of the titanium product. When a lightweight titanium product is needed, the reduction ratio may be decreased to increase the void fraction in the inner portion of the titanium product.

EXAMPLE

The following is a description of examples of the present invention. The conditions in the examples are exemplary conditions employed to verify the feasibility and effects of the present invention, and the present invention is not limited to the exemplary conditions. The present invention may employ various conditions without departing from the scope of the present invention and to the extent that objects of the present invention can be achieved.

Example 1

Titanium-containing structures having a rectangular parallelepiped shape of 75 mm thickness, 100 mm width, and 120 mm length were produced, each using, as the filler, titanium sponge and/or titanium scrap shown in Table 1 produced by the Kroll process, and as the package, six pickled plates of a commercially pure titanium material (industrial wrought commercially pure titanium material) shown in Table 1.

The titanium sponge used had an average particle size of 8 mm (particle sizes ranging from 0.25 to 19 mm) after screening and had a chemical composition corresponding to one of the chemical compositions of JIS Class 1 to JIS Class 4. The titanium scrap used was approximately 10 mm-square cut pieces of scrap of a JIS Class 1 titanium sheet (TP270C, 0.5 mm thick) generated in the production process. The commercially pure titanium materials used were pickled plates (5 to 10 mm thick) of JIS Class 1 (TP270H), JIS Class 2 (TP340H), JIS Class 3 (TP480H), or JIS Class 4 (TP550H). In advance, the structures of the cross sections of the plates were observed with an optical microscope and their photographs were taken. As for the grain size, the average grain size of the $\alpha$ phase in the surface layer of each plate was determined by the intercept method in accordance with JIS G 0551 (2005). The results are shown in Table 1.

A pre-assembly was formed from five pieces of the commercially pure titanium material. Titanium sponge was packed into the pre-assembly, which was then capped by the remaining piece of commercially pure titanium material. In this state, it was placed in a vacuum chamber and the pressure was reduced (evacuated) to a predetermined pressure, and thereafter the seams of the package were welded all around by electron beam (EB). The pressure within the chamber at that time was $8.8\times10^{-3}$ to $7.8\times10^{-2}$ Pa.

For some titanium-containing structures (Nos. 2 to 4 in Table 1), the pre-assembly of the package was formed in the following manner. One piece of a commercially pure titanium material was provided with a titanium tube having a 6 mm inside diameter TIG welded to a hole formed in the center of the plate and this piece of commercially pure titanium material served as the rear end face in rolling. The seams of the package were welded all around by TIG welding in an Ar gas atmosphere. Subsequently, the internal pressure of the package was reduced to a predetermined pressure ($1.7\times10^{-1}$ to 150 Pa) through the titanium tube, and after the pressure reduction, the titanium tube was crimped to maintain the pressure within the package.

For comparison, packed bodies in which the seams of the packages were welded all around by TIG welding in atmospheric air (air) atmosphere or Ar gas atmosphere were also produced (Nos. 22 and 23 in Table 1).

Furthermore, in place of the package, a titanium ingot was produced by melting the entire surface of a molded body of titanium sponge by electron beam (EB). The cross sections of some portions of the surface layer in the titanium ingot were observed, and it was found that the melt thickness was 8 mm and the average grain size of the portions was 0.85 mm (No. 24).

In the manners described above, titanium-containing structures were prepared. In each of them, titanium sponge or titanium scrap was packed and the atmosphere was a vacuum (vacuum pressure of $8.8\times10^{-3}$ to 150 Pa), atmospheric air, or Ar gas.

The produced titanium-containing structures were heated to 850° C. in an atmospheric air atmosphere and then hot rolled at a reduction ratio of 20 to 93% to produce titanium products. The resultant titanium products were annealed at 725° C. and then tensile test specimens were cut therefrom. In the case where the titanium product has a thickness of not greater than 10 mm, the tensile test specimens were cut with the thickness as it is, whereas in the case where the thickness is greater than 10 mm, 5 mm-thickness tensile test specimens were cut from a thicknesswise central portion of the titanium product. The tensile test specimens prepared were of the JIS No. 13 B size, in which the parallel portion width is 12.5 mm, the length is 60 mm, and the gauge length is 50 mm. The tensile strength and total elongation in a direction parallel to the direction in which the titanium material was rolled were evaluated. Table 1 shows the titanium-containing structures, reduction ratios for hot rolling, and tensile strengths and total elongations of titanium products of Example 1.

TABLE 1

| | | Package | | | | Filter | | | | Titanium containing | |
|---|---|---|---|---|---|---|---|---|---|---|---|
| | | | | Grain size | Process | Chemical Composition | | | | Structure | |
| | No | Chemical Composition | Thickness (mm) | of surface layer (μm) | for Welding | Titanium sponge | Titanium scrap | Account (mass %) | Shape | Internal Atmosphere | Internal Pressure (Pa) |
| Inventive Examples | 1 | JIS Class 1 | 10 | 30 | EB | JIS Class 1 | — | 0 | compression molded block | vacuum | $8.8 \times 10^{-3}$ |
| | 2 | JIS Class 1 | 10 | 30 | TIG | JIS Class 1 | — | 0 | compression molded block | vacuum | $1.7 \times 10^{-1}$ |
| | 3 | JIS Class 1 | 5 | 22 | TIG | JIS Class 1 | — | 0 | compression molded block | vacuum | $6.9 \times 10^{-1}$ |
| | 4 | JIS Class 1 | 10 | 30 | TIG | JIS Class 1 | — | 0 | compression molded block | vacuum | 1.2 |
| | 5 | JIS Class 1 | 10 | 30 | EB | JIS Class 1 | — | 0 | compression molded block | vacuum | $3.4 \times 10^{-2}$ |
| | 6 | JIS Class 1 | 10 | 25 | EB | JIS Class 1 | — | 0 | compression molded block | vacuum | $7.8 \times 10^{-2}$ |
| | 7 | JIS Class 1 | 10 | 25 | EB | JIS Class 1 | — | 0 | compression molded block | vacuum | $1.2 \times 10^{-2}$ |
| | 8 | JIS Class 1 | 10 | 30 | EB | JIS Class 1 | — | 0 | compression molded block | vacuum | $2.3 \times 10^{-2}$ |
| | 9 | JIS Class 1 | 10 | 30 18 | EB | JIS Class 1 | — | 0 | compression molded block | vacuum | $1.9 \times 10^{-2}$ |
| | 10 | JIS Class 1 | 5 | 18 | EB | JIS Class 1 | — | 0 | as-sponge | vacuum | $4.9 \times 10^{-2}$ |
| | 11 | JIS Class 1 | 5 | 18 | EB | JIS Class 1 | — | 0 | as-sponge | vacuum | $0.7 \times 10^{-3}$ |
| | 12 | JIS Class 1 | 10 | 30 | EB | JIS Class 1 | JIS Class 1 | 20 | compression molded block | vacuum | $2.2 \times 10^{-2}$ |
| | 13 | JIS Class 1 | 10 | 30 | EB | — | JIS Class 1 | 100 | compression molded block | vacuum | $1.1 \times 10^{-2}$ |
| | 14 | JIS Class 2 | 10 | 22 | EB | JIS Class 2 | — | 0 | compression molded block | vacuum | $2.6 \times 10^{-2}$ |
| | 15 | JIS Class 2 | 5 | 17 | EB | JIS Class 2 | — | 0 | as-sponge | vacuum | $7.5 \times 10^{-2}$ |
| | 16 | JIS Class 2 | 10 | 22 | EB | JIS Class 2 | JIS Class 2 | 20 | compression molded block | vacuum | $3.0 \times 10^{-2}$ |
| | 17 | JIS Class 3 | 10 | 18 | EB | JIS Class 3 | — | 0 | compression molded block | vacuum | $3.9 \times 10^{-2}$ |
| | 18 | JIS Class 3 | 5 | 16 | EB | JIS Class 3 | — | 0 | as-sponge | vacuum | $8.3 \times 10^{-2}$ |
| | 19 | JIS Class 4 | 10 | 15 | EB | JIS Class 4 | — | 0 | compression molded block | vacuum | $1.1 \times 10^{-2}$ |
| | 20 | JIS Class 4 | 5 | 16 | EB | JIS Class 4 | — | 0 | as-sponge | vacuum | $4.8 \times 10^{-2}$ |
| Comparative Examples | 21 | JIS Class 1 | 10 | 30 | TIG | JIS Class 1 | | 0 | compression molded block | vacuum | 150 |
| | 22 | JIS Class 1 | 10 | 30 | TIG | JIS Class 1 | | 0 | compression molded block | air | — |
| | 23 | JIS Class 1 | 10 | 30 | TIG | JIS Class 1 | | 0 | compression molded block | Ar | — |
| | 24 | JIS Class 1 | 8 | 1100 | EB | JIS Class 1 | — | 0 | compression molded block | vacuum | $7.4 \times 10^{-2}$ |
| | 25 | JIS Class 1 | 5 | 18 | EB | JIS Class 1 | — | 0 | as-sponge | vacuum | $5.5 \times 10^{-2}$ |

| | | | | | Titanium Bar | | | |
|---|---|---|---|---|---|---|---|---|
| | | Hot Forging | | | | Fraction | | |
| | No | Reduction Ratio (%) | Surface Defective | Diameter (mm) | Bulk Density | of Inner Portion (%) | Tensile Strength (MPa) | Total Elongation (%) |
| Inventive Examples | 1 | 91 | None | 5.6 | 4.51 | 0.1 | 336 | 57 |
| | 2 | 91 | None | 5.6 | 4.51 | 0.1 | 325 | 55 |
| | 3 | 91 | None | 5.5 | 4.51 | 0.1 | 335 | 53 |
| | 4 | 91 | None | 5.5 | 4.50 | 0.3 | 320 | 53 |
| | 5 | 93 | None | 4.8 | 4.51 | 0.02 | 341 | 59 |
| | 6 | 91 | None | 5.5 | 4.51 | 0.1 | 343 | 51 |
| | 7 | 90 | None | 6.5 | 4.50 | 0.2 | 319 | 63 |
| | 8 | 87 | None | 8 | 4.49 | 0.5 | 322 | 63 |
| | 9 | 82 | None | 12 | 4.49 | 0.0 | 302 | 49 |
| | 10 | 30 | None | 52 | 3.55 | 26 | 212 | 29 |
| | 11 | 50 | None | 37 | 4.26 | 7.0 | 269 | 33 |

TABLE 1-continued

| | | | | | | | | |
|---|---|---|---|---|---|---|---|---|
| | 12 | 91 | None | 5.5 | 4.50 | 0.2 | 320 | 53 |
| | 13 | 91 | None | 5.5 | 4.50 | 0.3 | 340 | 47 |
| | 14 | 91 | None | 5.5 | 4.50 | 0.2 | 390 | 38 |
| | 15 | 72 | None | 20 | 4.38 | 4.0 | 325 | 26 |
| | 16 | 91 | None | 5.5 | 4.48 | 0.6 | 378 | 37 |
| | 17 | 91 | None | 5.5 | 4.48 | 0.9 | 585 | 30 |
| | 18 | 72 | None | 20 | 0.28 | 8.0 | 485 | 21 |
| | 19 | 91 | None | 5.5 | 4.48 | 1.6 | 590 | 24 |
| | 20 | 72 | None | 20 | 4.20 | 10 | 521 | 15 |
| Comparative Examples | 21 | 91 | None | 5.5 | 4.48 | 0.5 | 240 | 26 |
| | 22 | — | — | — | — | — | — | — |
| | 23 | — | — | — | — | — | — | — |
| | 24 | 91 | Many | 5.5 | 4.51 | 0.1 | 311 | 52 |
| | 25 | 20 | None | 60 | 3.01 | 40 | — | — |

As shown in Table 1, the titanium products of Nos. 1 to 9, which were produced by preparing a titanium-containing structure in which the vacuum pressure was not greater than 10 Pa and hot rolling it at a reduction ratio of not less than 82%, had a low void fraction, namely less than 1%, and exhibited good tensile strength and total elongation.

In the cases where low reduction ratios, namely 30% and 50%, were employed, each titanium product had increased voids and as a result exhibited a tensile strength and a total elongation lower than those of the above-described cases, but by virtue of the reduced bulk density, weight reduction was achieved (Nos. 10 and 11). However, at a reduction ratio of 20%, the titanium product had a void fraction of 40% and therefore had a reduced weight, but delamination occurred at the interface between the surface layer and the inner layer (corresponding to the interface between the package and the filler in the titanium-containing structure), and consequently production of a plate was not accomplished (No. 25).

Also, in the cases where titanium scrap was used partially or entirely, hot working performed at a reduction ratio of 91% resulted in production of titanium products having void fraction of less than 1% and having tensile strengths and total elongations comparable to those of conventional products (Nos. 12, 13, and 16).

Also, in the cases where titanium sponge having a chemical composition corresponding to one of the chemical compositions of JIS Class 2 to JIS Class 4 and commercially pure titanium materials of one of the classes of JIS Class 2 to JIS Class 4, hot rolling performed at a reduction ratio of 91% resulted in production of titanium products having tensile strengths and total elongations comparable to those of conventional products (Nos. 14, 17, and 19). In the cases where the reduction ratio was 72%, although the tensile strength and total elongation slightly decreased as a result of the increased void fraction, but by virtue of the reduced bulk density, weight reduction was achieved (Nos. 15, 18, and 20).

The product No. 21, which was produced by preparing a titanium packed body in which the vacuum pressure is 150 Pa and hot rolling it at a reduction ratio of 91%, had a low void fraction, comparable to those of the titanium products Nos. 1 to 4, which were produced at the same reduction ratio, but the product No. 21 exhibited a lower tensile strength and total elongation than the products Nos. 1 to 4. This was due to insufficient collapse between pieces of the titanium sponge, which resulted from oxidation of the surface of the titanium sponge, and weight reduction was impossible and the tensile strength and total elongation decreased, and therefore this case is not preferred. In the cases of Nos. 22 and 23, in which atmospheric air (air) or Ar gas was present in the packed bodies, the packed bodies swelled when heated and they deformed before being subjected to hot rolling, and as a result they could not be hot rolled.

In the case of the titanium ingot produced by melting the surface, many scab surface defects were formed in the surface of the titanium product after hot rolling. Since the surface of the ingot was melted and solidified, the surface layer had been exposed to elevated temperatures of not less than 1000° C., and this caused rapid growth and coarsening of the grains in the surface layer. Since the amount of deformation varies among grains having different crystal orientations, the sites of coarse grains in the surface layer deformed into recesses or overlaps at an initial stage of hot rolling, and as the hot rolling progressed, they deformed into scab surface defects. Thus, the defective portions needed to be taken care of and removed (No. 24).

The results described above demonstrate that, when titanium products are produced by preparing a titanium-containing structure in which titanium sponge is packed and the vacuum pressure is not greater than 10 Pa and hot rolling it at a reduction ratio of not less than 90%, they exhibit a total elongation comparable to those of titanium products produced through a typical process that includes melting and forging steps.

Example 2

Titanium-containing structures having a cylindrical shape of 150 mm diameter and 250 mm length were produced, each using, as the filler, titanium sponge or titanium scrap shown in Table 2 produced by the Kroll process, and a package shown in Table 2.

The titanium sponge used had an average particle size of 6 mm (particle sizes ranging from 0.25 to 12 mm) after screening and had a chemical composition corresponding to one of the chemical compositions of JIS Class 1 to JIS Class 4. The titanium scrap used was approximately 10 mm-square cut pieces of scrap of a JIS Class 1 titanium sheet (TP270C, 0.5 mm thick) generated in the production process. The commercially pure titanium materials (industrial wrought commercially pure titanium materials) used were pickled plates (10 mm thick) of JIS Class 1 (TP270H), JIS Class 2 (TP340H), JIS Class 3 (TP480H), or JIS Class 4 (TP550H). In advance, the structures of the cross sections of the plates were observed with an optical microscope and their photographs were taken. As for the grain size, the average grain size of the α phase in the surface layer of each plate was determined by the intercept method in accordance with JIS G 0551 (2005). The results are shown in Table 2.

A pre-assembly was formed by rolling up one package member into a cylindrical shape and welding the two end faces together by electron beam (EB) welding, and joining a circular package member of 150 min in diameter thereto as the bottom face. Titanium sponge that had been previously compression molded into a cylindrical shape was packed into the pre-assembly, which was then capped by a circular titanium package member. The pre-assembly of the package was placed in a vacuum chamber and the pressure was reduced (evacuated) to a predetermined pressure, and thereafter the seams of the package were welded all around by electron beam (EB). The pressure within the chamber at that time was $9.5\times10^{-3}$ to $8.8\times10^{-2}$ Pa.

For comparison, a titanium ingot was produced by compression molding titanium sponge into a cylindrical shape and then melting the entire surface by electron beam (EB). The cross section of the surface layer at a portion of the titanium ingot was observed, and it was found that the melt thickness was 6 mm and the average grain size in the portion was 0.85 mm (No. 13).

The produced cylindrical titanium-containing structures were heated to 950° C. in an air atmosphere and then hot forged to produce round bars having diameters ranging from 32 to 125 mm. The produced round bars were annealed at 725° C. and then tensile test specimens were cut from a radially central portion thereof to prepare JIS No. 4 test specimens (14 mm in parallel portion diameter and 60 mm in length) and determine the tensile strengths and total elongations. Table 2 shows the titanium-containing structures, reduction ratios for hot forging, and tensile strengths and total elongations of titanium products of Example 2.

TABLE 2

| | | Package | | | | Filter | | | | Titanium containing | |
|---|---|---|---|---|---|---|---|---|---|---|---|
| | | | | | | Chemical Composition | | | | Structure | |
| | No. | Chemical Composition | Thickness (mm) | Grain size of surface layer (μm) | Process for Welding | Titanium sponge | Titanium scrap | Account (mass %) | Shape | Internal Atmosphere | Internal Pressure (Pa) |
| Inventive Examples | 1 | JIS Class 1 | 10 | 25 | EB | JIS Class 1 | — | | compression molded block | vacuum | $9.5 \times 10^{-3}$ |
| | 2 | JIS Class 1 | 10 | 25 | EB | JIS Class 1 | — | 0 | compression molded block | vacuum | $3.3 \times 10^{-2}$ |
| | 3 | JIS Class 1 | 10 | 25 | EB | JIS Class 1 | — | 0 | compression molded block | vacuum | $8.7 \times 10^{-2}$ |
| | 4 | JIS Class 1 | 10 | 25 | EB | JIS Class 1 | — | 0 | compression molded block | vacuum | $4.2 \times 10^{-2}$ |
| | 5 | JIS Class 1 | 10 | 25 | EB | JIS Class 1 | JIS Class 1 | 30 | compression molded block | vacuum | $6.3 \times 10^{-2}$ |
| | 6 | JIS Class 2 | 10 | 22 | EB | JIS Class 2 | — | 0 | compression molded block | vacuum | $6.2 \times 10^{-2}$ |
| | 7 | JIS Class 2 | 10 | 22 | EB | JIS Class 2 | — | 0 | compression molded block | vacuum | $3.2 \times 10^{-2}$ |
| | 8 | JIS Class 2 | 10 | 22 | EB | JIS Class 2 | JIS Class 2 | 20 | compression molded block | vacuum | $5.8 \times 10^{-2}$ |
| | 9 | JIS Class 3 | 10 | 18 | EB | JIS Class 3 | — | 0 | compression molded block | vacuum | $7.9 \times 10^{-2}$ |
| | 10 | JIS Class 3 | 10 | 18 | EB | JIS Class 3 | — | 0 | compression molded block | vacuum | $6.1 \times 10^{-2}$ |
| | 11 | JIS Class 4 | 10 | 16 | EB | JIS Class 4 | — | 0 | compression molded block | vacuum | $3.2 \times 10^{-2}$ |
| | 12 | JIS Class 4 | 10 | 16 | EB | JIS Class 4 | — | 0 | compression molded block | vacuum | $8.8 \times 10^{-2}$ |
| Comparative Examples | 13 | JIS Class 1 | 6 | 850 | EB | JIS Class 1 | — | 0 | compression molded block | vacuum | $4.5 \times 10^{-2}$ |
| | 14 | JIS Class 1 | 10 | 22 | EB | JIS Class 1 | — | 0 | as-sponge | vacuum | $7.1 \times 10^{--2}$ |

| | | Hot Forging | | Titanium Bar | | | | |
|---|---|---|---|---|---|---|---|---|
| | No. | Reduction Ratio (%) | Surface Defective | Diameter (mm) | Bulk Density | Fraction of Inner Portion (%) | Tensile Strength (MPa) | Total Elongation (%) |
| Inventive Examples | 1 | 94 | None | 32 | 4.51 | 0.1 | 319 | 48 |
| | 2 | 92 | None | 42 | 4.48 | 1.1 | 311 | 46 |
| | 3 | 84 | None | 60 | 4.39 | 3 | 282 | 44 |
| | 4 | 56 | None | 100 | 4.12 | 12 | 260 | 35 |
| | 5 | 92 | None | 42 | 4.47 | 1.3 | 320 | 45 |
| | 6 | 94 | None | 32 | 4.51 | 0.2 | 401 | 38 |
| | 7 | 84 | None | 60 | 4.40 | 4.3 | 368 | 29 |
| | 8 | 94 | None | 32 | 4.50 | 0.3 | 415 | 35 |
| | 9 | 94 | None | 32 | 4.48 | 0.9 | 545 | 28 |
| | 10 | 84 | None | 60 | 4.35 | 5.2 | 458 | 20 |
| | 11 | 94 | None | 32 | 4.45 | 1.6 | 704 | 20 |

TABLE 2-continued

| | | | | | | | | |
|---|---|---|---|---|---|---|---|---|
| | 12 | 84 | None | 60<br>60 | 4.28 | 7.3 | 572 | 14 |
| Comparative Examples | 13 | 94 | Many | 32 | — | — | — | — |
| | 14 | 36 | None | 125 | 3.24 | 39 | — | — |

As shown in Table 2, some round bars were produced by hot forging a titanium-containing structure at a reduction ratio of not less than 90%. They had low void fractions in the inner portions, namely less than 1%, and exhibited good tensile strengths and total elongations comparable to those of conventional products (Nos. 1, 2, 6, 9, and 11).

Some round bars were produced by hot forging a titanium-containing structure at a reduction ratio of 56 or 84%. They exhibited tensile strengths and total elongations slightly lower than those of conventional products but had void fractions in the inner portions ranging from 3% to 12% and thus achieved correspondingly reduced weights (Nos. 3, 4, 7, 10, and 12).

However, in No. 14, which employed a low reduction ratio of 36%, the produced titanium round bar had a high void fraction in the inner portion, namely 39%, and therefore had a reduced weight, but delamination occurred at the interface between the surface layer and the inner layer (corresponding to the interface between the package and the filler in the titanium-containing structure), and consequently production of the round bar was not accomplished.

Some round bars were produced by preparing a titanium-containing structure in which titanium scrap (chips) was included in lieu of part of titanium sponge and subjecting the structure to hot forging. They had low void fractions in the inner portions, namely less than 1%, and exhibited good tensile strengths and total elongations comparable to those of conventional products (Nos. 5 and 8). A titanium ingot produced by melting the surface had many surface cracks formed during hot forging. Since the surface of the ingot was melted and solidified, the surface layer had been exposed to elevated temperatures of not less than 1000° C., and this caused rapid growth and coarsening of the grains in the surface layer. At an initial stage of hot forging, small cracks were formed at the boundaries of the coarse grains in the surface layer, and as the hot forging progressed, the cracks propagated to form large surface cracks. In a portion, a large crack as deep as 15 mm was formed, and consequently, forging to a predetermined size was not accomplished (No. 13).

INDUSTRIAL APPLICABILITY

The present invention enables production of a titanium product by performing hot working while eliminating the conventional melting step and forging step and therefore achieves a reduction in energy necessary for the production. Furthermore, the production is accomplished without removal of large amounts of titanium material by cutting or severing, i.e., for example, removal by cutting of defective portions that are present mainly in the surface layer and bottom surface of an ingot or removal of surface cracks and poorly shaped front and rear end portions (crops) after forging, and therefore the production yield is significantly improved and consequently a significant reduction in production cost is achieved. Furthermore, titanium products having tensile properties comparable to those of conventional products are provided. Thus, the present invention has high industrial applicability.

REFERENCE SIGNS LIST

1 package
1*a* commercially pure titanium material
2 filler
3 void
4 weld zone
10 titanium-containing structure
20*a*, 20*b* titanium material
21*a*, 21*b* outer layer
22*a*, 22*b* inner layer
23*a*, 23*b* void

The invention claimed is:

1. A titanium-containing structure consisting of:
a package made of a commercially pure titanium material; and
a filler packed into the package, the package with the filler packed into the package being sealed so that an internal pressure of the package is 10 Pa or less, the pressure being an absolute pressure; and
wherein the filler comprises at least one selected from titanium sponge, titanium briquet and titanium scrap, and the filler and the package belongs to the same class of JIS standard in terms of chemical composition; and
wherein a thickness of the package made of the commercially pure titanium material is 3 to 25% of a thickness of the titanium-containing structure.

2. The titanium-containing structure according to claim 1, wherein the chemical composition of each of the package and the filler is stipulated in JIS Class 1 to JIS Class 4.

3. A titanium product having an outer layer and an inner layer entirely surrounded by the outer layer, wherein
the outer layer is made from wrought titanium material having a chemical composition stipulated in JIS Class 1 to JIS Class 4, and
the inner layer and the outer layer belong to the same class of JIS standard in terms of chemical composition wherein a void fraction in the inner layer is more than 0% and 12% or less.

4. The titanium product according to claim 3, wherein the void fraction in the inner layer is not less than 0.02%.

5. The titanium product according to claim 3, wherein the void fraction in the inner layer is not less than 0.1%.

* * * * *